US006347609B1

(12) United States Patent
Bloomer

(10) Patent No.: US 6,347,609 B1
(45) Date of Patent: Feb. 19, 2002

(54) WEDGE SECTION MULTI-CHAMBER RESONATOR ASSEMBLY

(75) Inventor: Stephen F. Bloomer, London (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/672,405

(22) Filed: Sep. 28, 2000

Related U.S. Application Data

(60) Provisional application No. 60/158,921, filed on Oct. 12, 1999.

(51) Int. Cl.[7] ..... F02M 35/10
(52) U.S. Cl. ..... 123/184.57; 181/247
(58) Field of Search ..... 123/184.57; 181/204, 181/205, 247, 249

(56) References Cited

U.S. PATENT DOCUMENTS 1,611,475 A 12/1926 Maxim
1,924,605 A * 8/1933 Haas et al. ..... 181/247
2,075,088 A 3/1937 Blanchard
4,393,652 A * 7/1983 Munro ..... 181/249
5,040,495 A * 8/1991 Harada et al. ..... 123/184.57
5,173,576 A * 12/1992 Feuling ..... 181/247
5,918,572 A * 7/1999 Suzuki ..... 123/184.57
5,957,102 A * 9/1999 Schorn ..... 123/184.57
6,105,546 A * 8/2000 Fuesser et al. ..... 123/184.57
6,155,225 A * 12/2000 Suzuki ..... 123/184.57

FOREIGN PATENT DOCUMENTS

DE 262984 9/1912

* cited by examiner

*Primary Examiner*—Marguerite McMahon

(57) ABSTRACT

An air resonator for an air intake system includes a plurality of serially positioned increasing volume chambers. Air passing to the engine passes through these chambers. Noise passing from the engine back towards the source of air will also pass through these increasing volume chambers. As the noise serially passes through the increasing and then decreasing volume, the noise is dissipated.

23 Claims, 2 Drawing Sheets

WEDGE SECTION MULTI-CHAMBER RESONATOR ASSEMBLY

This application claims priority to provisional patent application Serial No. 60/158,921, which was filed Oct. 12, 1999.

BACKGROUND OF THE INVENTION

This invention relates to an air resonator assembly for use in reducing noise adjacent to a vehicle engine wherein the air passes through a plurality of expanding and contracting chambers.

Vehicle engines are subject to a good deal of engineering effort. One major effort is to reduce the noise associated with an engine. An engine typically has an air supply system that communicates a source of air to the engine. This air supply system is also a source of noise, in that noise tends to travel back upstream towards the source of air from the engine. Thus, the air intake systems for engines are typically provided for a resonator assembly. The goal of resonator assemblies as used in the prior art is to reduce the engine noise to the extent possible.

While known air resonator systems have reduced the engine noise somewhat, it would still be desirable to further reduce engine noise. Typically, known resonator systems include a single chamber which communicates with the air supply to provide a chamber for dissipating engine noise.

The present invention discloses a system wherein the air flow and thus the engine noise each experience a series of expanding and contracting chambers.

SUMMARY OF THE INVENTION

In the disclosed embodiment of this invention, a resonator chamber is placed between a source of air and a vehicle engine. Air passes through the resonator chamber to the engine, and noise from the engine passes back through the chamber toward the source of air. The resonator chamber is preferably formed of a plurality of chambers which are of changing volume. Preferably, the engine noise passes into a chamber of relatively large volume which converges to a smaller volume. The noise then passes through a first chamber port of the first chamber and then into another enlarged volume which is again reduced. Air on the other hand enters into the chambers at a smaller area and moves towards a larger volume before passing through the ports. As known, the air passes in an opposed direction relative to the noise. The noise is repeatedly dissipated by the serially encountered expanding chambers.

In one disclosed embodiment the resonator is relatively flat, and formed of a plurality of wedge-shaped chambers. The air flow moves to one end of the resonator through a plurality of expanding volume wedge-shaped chambers and then back in an opposed direction through a second plurality of expanding wedge-shaped chambers. The vehicle noise goes through an opposed direction.

In a second embodiment, a plurality of bowl-shaped chambers are each positioned serially at a center of an outer resonator body with an enlarged chamber surrounding the bowl-shaped chambers. Air moving towards the engine moves through the serially connected bowl-shaped chambers into the surrounding chamber, and then back to the engine. Noise from the engine moves in an opposed direction such that it initially moves through the enlarged surrounding chambers back into the bowl-shaped central chambers. In this way, the noise is beneficially dissipated by the serially encountered increased and decreasing sized chambers.

These and other features of the present invention can be best understood from the following specification and drawings, the following of which is a brief description.

DETAILED DESCRIPTION OF A PREFERRED EMBODIMENT

Figure 1A:
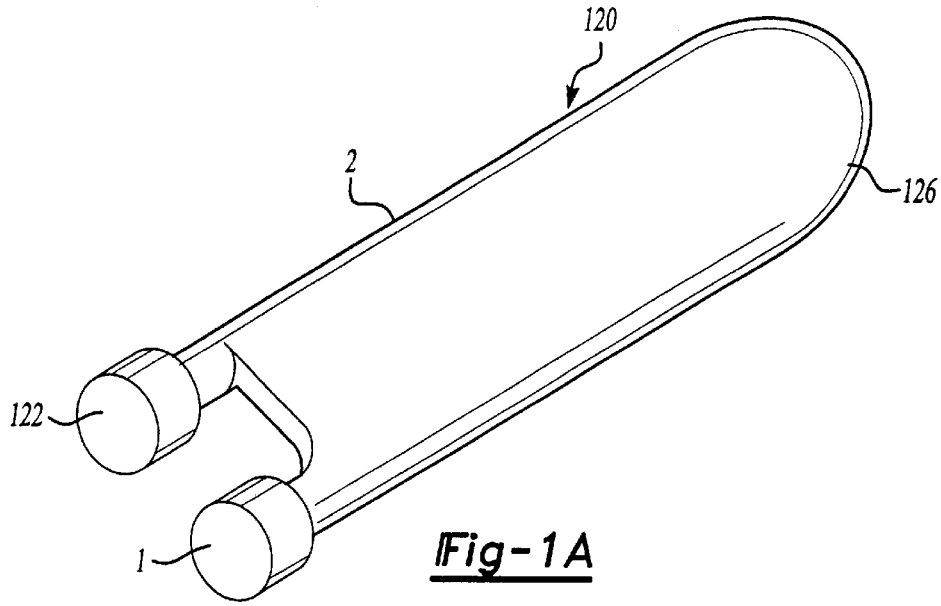
FIG. 1A is a schematic view of a resonator mounted in a vehicle.

FIG. 1A shows an engine system 120 incorporating a source of air 122 communicating with an inlet 2 on an air resonator 126. An outlet 1 communicates with the engine 124.

Figure 1B:
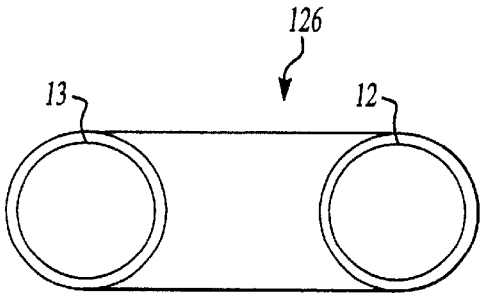
FIG. 1B is a top view of a first embodiment.
Figure 1C:
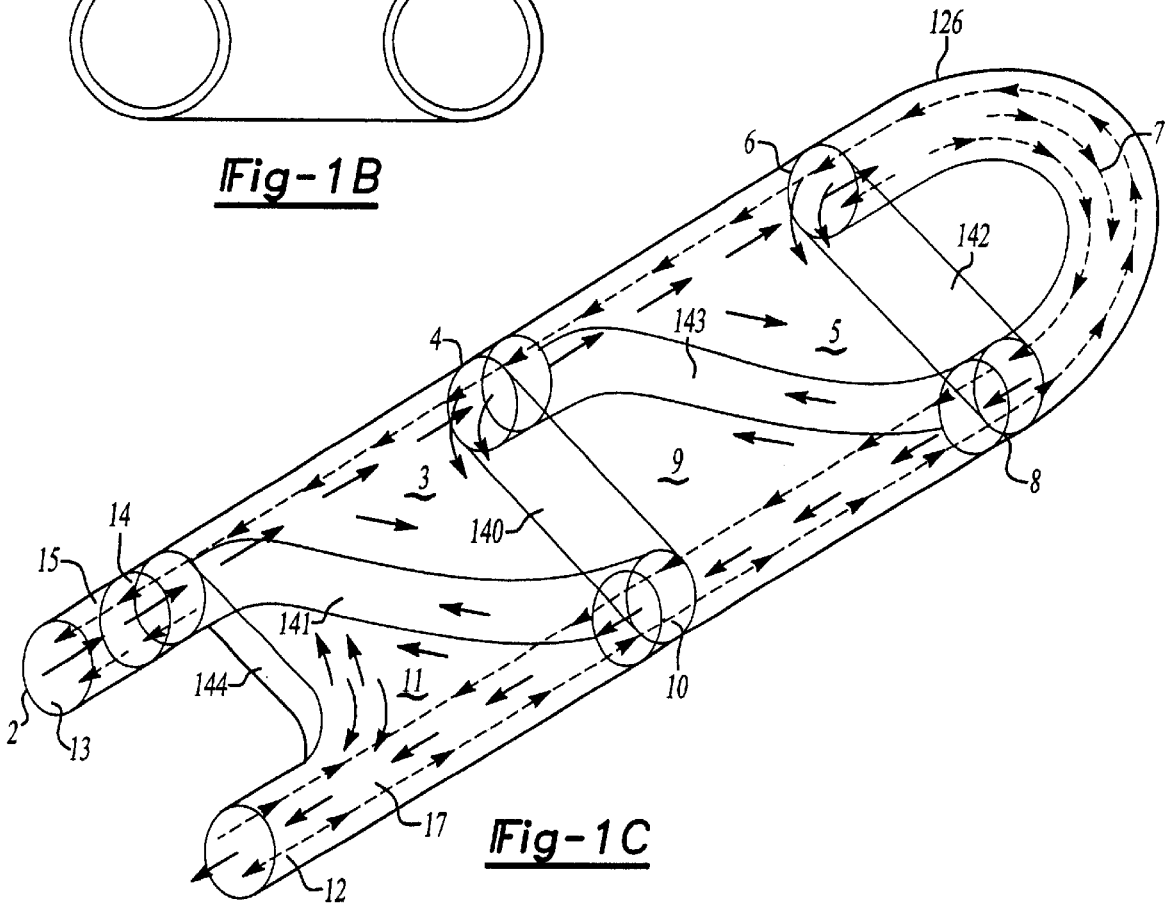
FIG. 1C is a view along line C as shown in FIG. 1B.

As can be appreciated from FIGS. 1B and C, the resonator 126 is relatively flat in this embodiment. An intake port 13 communicates with the source of air 122 and an outlet port 12 communicates with the engine 124. From the intake port 13, air flows through a first central passage 15 to a first port 14. From the first port 14 air can flow into a wedge-shaped chamber 3, and then through another port 4. A wall 140 defines an end of the chamber 3 along with another wall 141. From the chamber 3, air passes through the pipe 4 to another wedge-shaped chamber 5. Wedge-shaped chamber 5 is defined by walls 142 and 143. Air from the chamber 5 then passes into the port 6, around through an 180° bend through tube 7 and back to the port 8. From the port 8, the air can enter a chamber 9 which is defined between the walls 143 and 140. The air then passes through another port 10 and into a final chamber 11. Chamber 11 is defined by wall 141 and 144. From the chamber 11 the air passes into the pipe 12, and back to the outlet connection 1.

As can be appreciated from FIG. 1B, the air serially encounters chambers of a small volume which increase to a large volume, and then pass through a restricted port. As known, noise from the engine pass in an opposed direction through the air intake system. Thus, the noise enters chambers 11, 9, 5 and 3 in that order. Each of the chambers has its largest volume at the point where the noise will enter the chamber, and the volume of the chamber decreases towards its connecting port. Thus, the noise enters a chamber and tends to be dissipated before passing to the next chamber. By the time the noise reaches the end of the resonator 126, the noise is drastically dissipated from that which enters the resonator from the engine. In this way, the serially connected wedge-shaped chambers dissipate a good deal of the vehicle noise.

Figure 2:
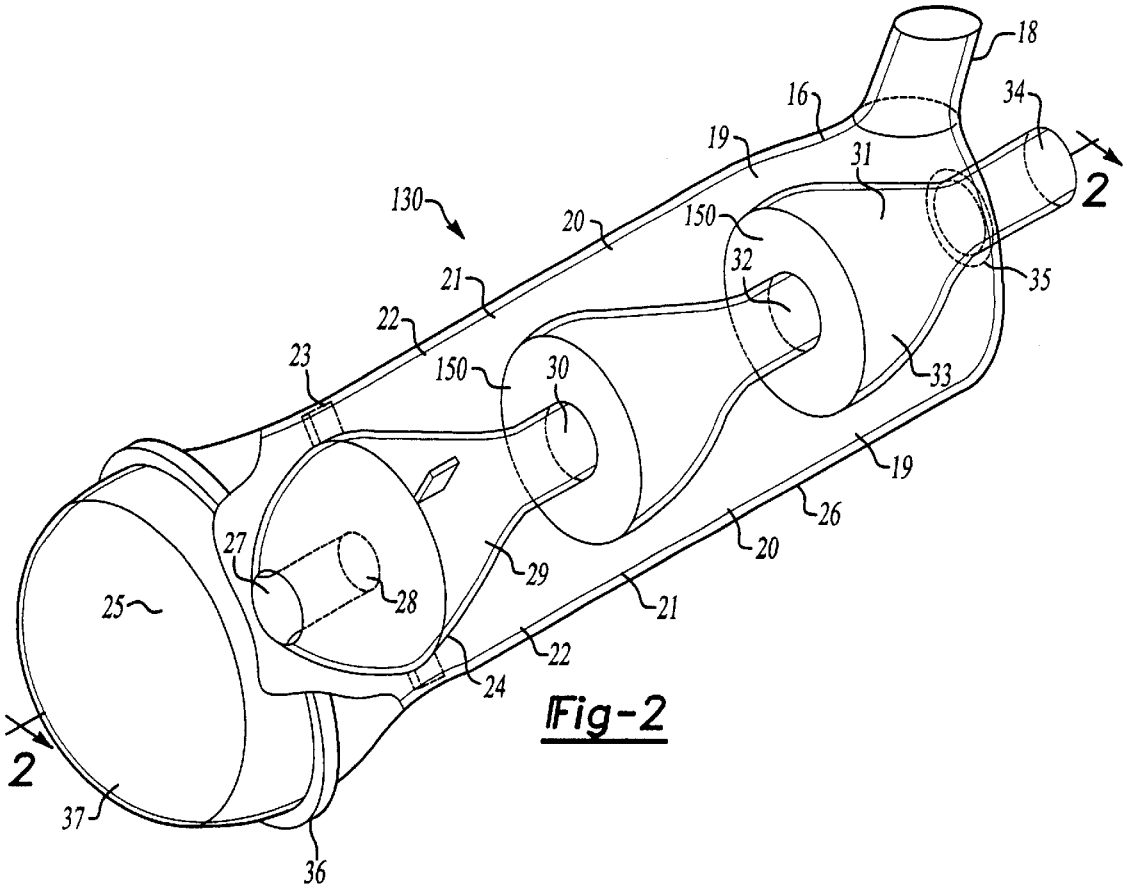
FIG. 2 shows a second embodiment.

A second embodiment 130 is illustrated in FIG. 2. In this embodiment a port 18 communicates with an engine and a port 34 communicates with a source of air. The source of air at the port 34 passes through a first bowl-shaped chamber 33 having a volume which increases from an upstream end toward a downstream end. A wall 150 defines an end of the chamber bowl 33, and a port 32 is received in the wall 150. A seal 35 surrounds the port 34 to seal the bowl chamber 33 within a surrounding body or chamber wall 19. Air passing into the port 32 then moves into a second bowl-shaped chamber 31. Again, an end wall 50 receives the next serial port 30 from its bowl-shaped chamber 29. A plurality of struts 23 mount bowl-shaped chamber 29 within the outer housing 19. Similar struts may mount the chambers 31 and 33. From the bowl-shaped chamber 29, air passes through a port 28 to an outlet 27. From outlet 27 the air passes into an end volume 25 defined by an end wall 37. A contact surface 36 between the end wall 37 and the housing 19 defines a sealed volume. From the volume 25 the air passes through a restriction defined adjacent the struts 23 into a chamber 22. Another restriction 21 is then encountered by the air prior to moving into a chamber 20. From the chamber 20 the air moves through yet another restriction 19 and into a final chamber 16 before reaching the port 18 to communicate with the engine.

Figure 3:
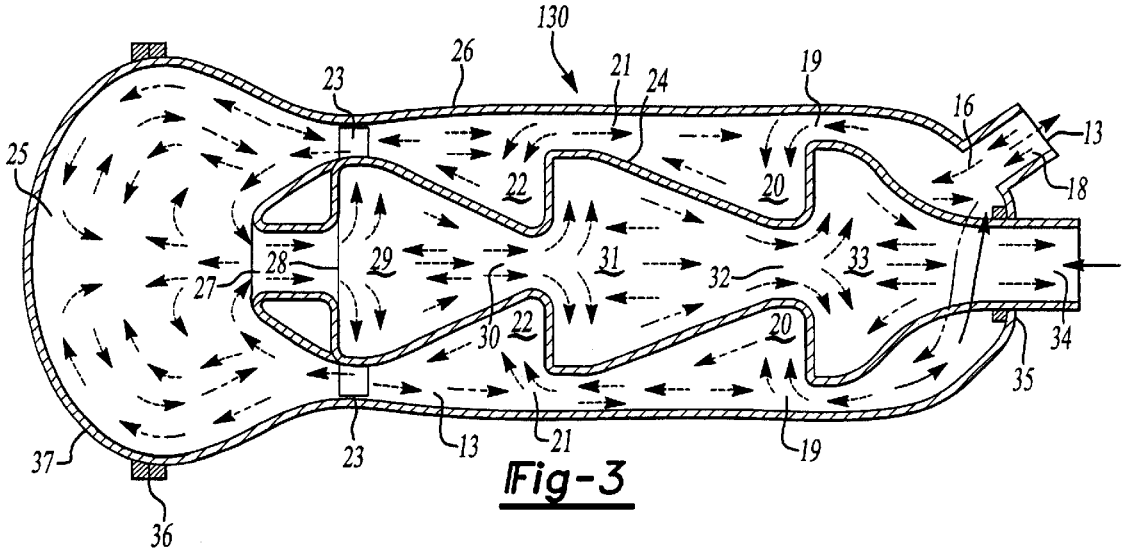
FIG. 3 is a cross-section through the second embodiment of FIG. 2.

As in the prior embodiment, the air flow passes through a series of chambers which are initially relatively small in volume and which increase. As can be appreciated from knowledge in this art, and from the description of the first embodiment, the noise from the engine will move in the opposed direction and will thus encounter chambers which initially have a larger volume which decreases. Thus, as can be appreciated from FIG. 3, the noise from the engine moves into the chamber 16 and through the restriction 19 before moving into the enlarged chamber to 20. From chamber 20 the noise passes through a port 21 into the chamber 22. From the chamber 22 the noise passes through a restriction defined adjacent to struts 23 into chamber 25. From chamber 25 the noise will have to pass through the port 27 into the chamber 29, the restriction 30 into the chamber 31 and the restriction 32 into the chamber 33 before passing through the outlet 34.

Again, the increasing and serially connected chambers dissipate the engine noise to a large extent. The engine noise reaching the air source will likely be greatly diminished over the prior art.

A worker in this art would recognize that many modifications would come within the scope of this invention. For that reason the following claims should be studied to determine the true scope and content of this invention.

What is claimed is:

1. An air intake system for an engine comprising:

a vehicle engine having an air intake port communicating with a source of air; and an air resonator mounted between said engine and said source of air, said air resonator having a plurality of chambers which are encountered serially by air passing from said source to said engine, said chambers having a volume which changes along a flow path, and which ends with a restriction leading into a next adjacent chamber, said air passes in a first direction, and then is bent back in a second direction generally opposed to said first direction into said engine.

2. An air supply system as set forth in claim 1, wherein said chambers move from a relatively small volume to a larger volume along a direction of said air flow path before encountering said restrictions.

3. An air supply system as set forth in claim 2, wherein said resonator chamber is relatively thin and said increasing volume chambers are provided by a plurality of wedge-shaped chambers.

4. An air supply system as set forth in claim 3, wherein said air flow passes in said first direction, then through an approximately 180° bend back in said second direction to said engine.

5. An air supply system as set forth in claim 4, wherein said wedge-shaped chambers are spaced adjacent to each other in a first direction and in an opposed direction such that air passes through one chamber moving in said first direction, and then passes through another chamber lying next to said one chamber when moving back in said second direction.

6. An air supply system as set forth in claim 5, wherein said wedge-shaped chambers are each defined by a central wall extending between two points to define said two wedge-shaped chambers.

7. An air supply system as set forth in claim 2, wherein said chambers are defined by a plurality of bowl-shaped chambers each of increasing volume, and which are mounted centrally within an enlarged surrounding chamber, air passing through said central chambers to an outlet at an end of said central chambers, and then around said central chambers through said surrounding chamber.

8. An air supply system as set forth in claim 7, wherein a plurality of struts support said central chamber within said outer chamber.

9. An air supply system as set forth in claim 8, wherein air passes through said central bowl-shaped chambers to an end chamber and then back around said bowl-shaped chambers.

10. An air intake system as set forth in claim 1, wherein walls separate each of a first set of said chambers through which air passes in said first direction from a second set of chambers through which said air will pass after having been bent back in said second direction, and such that substantially all of the air passing through said first set of chambers passes serially through said first set of chambers to be bent back in said second direction at an end of said air resonator.

11. An air supply system as set forth in claim 5, wherein walls separate each of aid chambers from said chamber lying next to said chambers, such that substantially all of the air passing through each of said chambers moves in said first direction until being bent back, and is then bent back in said second direction.

12. An air supply system as set forth in claim 7, wherein said plurality of bowl-shaped chambers are isolated from said surrounding chambers such that air passing through said bowl-shaped chambers passes to said outlet end before moving into said surrounding chambers.

13. An air resonator system for being positioned between a source of air and a vehicle engine, said air resonator system including a plurality of serially positioned chambers, with a volume of said chambers increasing in a flow direction for said air from a relatively small volume to greater volumes, and said chamber then passing through a restriction before moving into a next chamber, said air flows along a first direction to an end of said resonator, and then reverses flow in an opposed direction.

14. An air resonator as set forth in claim 13, wherein said resonator chamber is relatively thin and said increasing volume chambers are provided by a plurality of wedge-shaped chambers.

15. An air resonator as set forth in claim 14, wherein said air flow passes in a first direction, then through an approximately 180° bend back in an opposed direction to said engine.

16. An air resonator as set forth in claim 15, wherein said wedge-shaped chambers are spaced adjacent to each other in a first direction and in an opposed direction such that air passes through one chamber moving in said first direction, and then passes through another chamber lying next to said one chamber when moving back in said second direction.

17. An air resonator as set forth in claim 16, wherein said wedge-shaped chambers are each defined by a central wall extending between two points to define said two wedge-shaped chambers.

18. An air resonator as set forth in claim 13, wherein said chambers are defined by a plurality of bowl-shaped chambers each of increasing volume, and which are mounted centrally within an enlarged surrounding chamber, air passing through said central chambers to an outlet at an end of said central chambers, and then around said central chambers through said surrounding chamber.

19. An air resonator as set forth in claim 18, wherein a plurality of struts support said central chamber within said outer chamber.

20. An air resonator as set forth in claim 19, wherein air passes through said central bowl-shaped chambers to an end chamber and then back around said bowl-shaped chambers.

21. An air resonator system as set forth in claim 13, wherein walls separate each of said chambers through which air passes in said first direction from a second set of chambers through which said air will pass after having been bent back in said second direction, and such that substantially all of the air passing through said first set of chambers passes serially through said first set of chambers to be bent back in said second direction at an end of said air resonator.

22. An air resonator as set forth in claim 14, wherein walls separate each of aid chambers from said chamber lying next to said chambers, such that substantially all of the air passing through each of said chambers moves in said first direction until being bent back, and is then bent back in said second direction.

23. An air supply system as set forth in claim 16, wherein said plurality of bowl-shaped chambers are isolated from said surrounding chambers such that air passing through said bowl-shaped chambers passes to said outlet end before moving into said surrounding chambers.

* * * * *